US006638395B1

(12) United States Patent
Elenz

(10) Patent No.: US 6,638,395 B1
(45) Date of Patent: Oct. 28, 2003

(54) PAPER MACHINE AND PROCESS

(75) Inventor: Thomas Elenz, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 1 day.

(21) Appl. No.: 09/590,289

(22) Filed: Jun. 9, 2000

(30) Foreign Application Priority Data

Jul. 24, 1999 (DE) ..... 199 34 875

(51) Int. Cl.[7] ..... D21F 3/02; D21F 3/10

(52) U.S. Cl. ..... 162/202; 162/198; 162/109; 162/263; 162/358.3; 162/361; 162/368

(58) Field of Search ..... 162/109, 111, 162/117, 198, 358.1, 358.3, 263, 361, 363, 368, DIG. 6, DIG. 10, DIG. 11, 202, 360.2; 700/127–129

(56) References Cited

U.S. PATENT DOCUMENTS

| | | | | | |
|---|---|---|---|---|---|
| 3,678,594 | A | * | 7/1972 | Goerz, Jr. et al. | 34/264 |
| 4,309,246 | A | * | 1/1982 | Hulit et al. | 162/113 |
| 4,440,597 | A | * | 4/1984 | Wells et al. | 162/111 |
| 5,087,325 | A | | 2/1992 | Page | |
| 5,389,205 | A | | 2/1995 | Pajula et al. | |
| 5,611,893 | A | | 3/1997 | Pajula et al. | |
| 5,776,307 | A | * | 7/1998 | Ampulski et al. | 162/117 |
| 5,792,317 | A | * | 8/1998 | Taylor et al. | 162/175 |

(List continued on next page.)

FOREIGN PATENT DOCUMENTS

| | | |
|---|---|---|
| DE | 69208460 | 8/1996 |
| DE | 19636791 | 3/1998 |
| EP | 0770727 | 5/1997 |
| WO | 95/33885 | * 12/1995 |

OTHER PUBLICATIONS

Wolgang Schowerk, "Shoe Presses and Sleevess for Newsprint. Concepts and Initial Operating Experience," Paper age, Dec. 1997, pp 30–34.*

Wolgang Schowerk, "Shoe press technology– improvements in quality and output," Paper technology, Apr. 1999, pp 35–40.*

Bo–Christer Åberg, "Shoe Presses, Felts and Belts," Das Papier No. 6, 1996, pp 334–342.*

Gunnar Gavelin, "Fourdrinier Papermaking– Stock Supply through Presses," Lockwood Trade Journal Co. Inc., , NY 1963, pp74–101.*

*Primary Examiner*—Jose A. Fortuna
(74) *Attorney, Agent, or Firm*—Greenblum & Bernstein, P.L.C.

(57) ABSTRACT

Machine and process for at least one of producing and finishing a fibrous material web. The machine includes a press section, for dewatering the fibrous web, with a press nip, a former, located before, relative to a web travel direction, the press section for sheet formation, and a dryer section, located after the press section for drying the fibrous material web including a first dryer section having no more than three dryer cylinders. Two press rolls are arranged to form the press nip, and at least one press felt is located on each surface of the material web, such that the material web and the at least one press felt on each side of the material web are guided through the press nip. The fibrous material web is dewatered in the former to a dry content of at least approximately 18%, partially loops around the no more than three dryer cylinders, and is constantly supported from the former to an end of the first dryer group. The process includes dewatering the fibrous material web in the former to dry content of at least approximately 18%, dewatering the fibrous material web in only one press nip in the press section, and looping the fibrous material web around no more than three dryer cylinders in a first dryer group of the dryer section a dryer section. The fibrous material web is constantly supported between the former and an end of the first dryer group.

36 Claims, 1 Drawing Sheet

U.S. PATENT DOCUMENTS 5,830,316 A * 11/1998 Ampulski ..... 162/117
5,855,739 A * 1/1999 Ampulski et al. ..... 162/117
5,861,082 A * 1/1999 Ampulski et al. ..... 162/117
5,897,745 A * 4/1999 Ampulski et al. ..... 162/109
5,904,811 A * 5/1999 Ampulski et al. ..... 162/117
5,932,070 A 8/1999 Esslinger et al.
6,051,105 A * 4/2000 Ampulski ..... 162/117
6,090,244 A * 7/2000 Kotitschke ..... 162/306
6,099,690 A * 8/2000 Hu et al. ..... 162/198
6,103,062 A * 8/2000 Ampulski et al. ..... 162/109
6,193,839 B1 * 2/2001 Ampulski et al. ..... 162/117

* cited by examiner

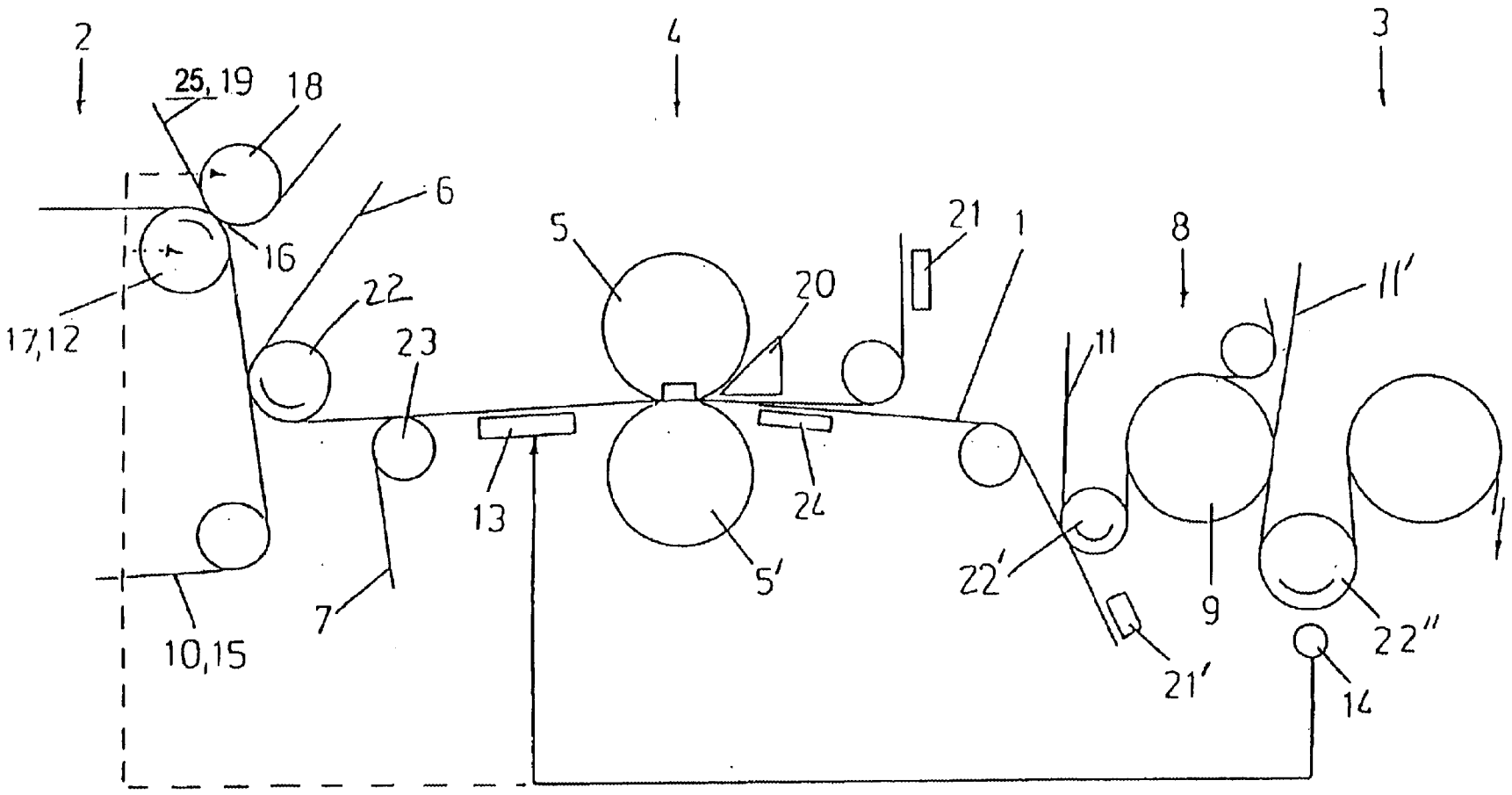
3
4
2
11'
22''
14
9
8
21'
11
22'
1
21
20
24
5'
5
13
6
23
22
7
18
16
25,19
10,15
17,12

PAPER MACHINE AND PROCESS

CROSS-REFERENCE TO RELATED APPLICATIONS

The present application claims priority under 35 U.S.C. §119 of German Patent Application No. 199 34 875.8, filed on Jul. 24, 1999, the disclosure of which is expressly incorporated by reference herein in its entirety.

BACKGROUND OF THE INVENTION

1. Field of the Invention

The invention relates to a machine for producing and/or finishing a fibrous material web having a press section for the dewatering thereof, a former for sheet formation situated before it, and a dryer section for drying the fibrous material web disposed after it.

2. Discussion of Background Information

Such machines are described, for example, in EP 770 727, in which the fibrous material web is guided through at least two elongated press nips of the press section jointly with multiple press felts. Because the fibrous material web in the press nips comes into contact with various press felts, irregularities in the ability to absorb water or the moisture content of the press felts observed crosswise to the fibrous material web can be better compensated. The result is that the moisture cross profile of the fibrous material web is relatively uniform.

The disadvantage here is the large space requirement and the relatively high expense of producing the two elongated press nips, which are formed in conjunction with relatively expensive shoe press rolls.

SUMMARY OF THE INVENTION

The object of the invention is therefore to create a paper machine having a press section that is as small but as efficient as possible and that involves the lowest possible cost.

This object is attained according to the invention in that the press section comprises only one press nip formed by two press rolls, through which, next to the fibrous material web, disposed on both sides thereof, at least one press felt is guided, the fibrous material web is dewatered in the former to a dry content of at least approximately 18%, preferably at least approximately 20%, the first dryer group of the dryer section includes a maximum of three heated dryer cylinders, which are partially looped around by the fibrous material web, and the fibrous material web is supported constantly from the former to the end of the first dryer group by at least one roll or one belt in the form of a former screen, a press felt, a transfer belt, or a dryer screen.

The dry content after the former of at least approximately 18%, preferably at least approximately 20%, allows the limitation to only one elongated press nip in the press section. However, due to the relatively high moisture content of the fibrous material web after the press nip, closed guidance of the fibrous material web from the former is important, in particular up to the end of the first dryer group, especially at high machine speeds. Moreover, stretching of the fibrous material web, even as a result of the high moisture content at the beginning of the dryer section, must be compensated as quickly as possible, which is why at least the first dryer group is designed to be as short as possible. Otherwise, the risk would arise of tearing the web or the formation of folds. Compensation for the stretching is generally achieved in that each subsequent dryer group is operated at a higher speed than the preceding one.

To ensure sufficient dewatering in the press nip, the length of the press nip should be greater than approximately 300 mm, preferably greater than approximately 500 mm. In order to guarantee sufficient pressing time, the web speed here should not exceed approximately 1,500 m/min. In addition, the line force in the press nip should be above approximately 800 KN/m, preferably above approximately 1,000 KN/m, and in particular above approximately 1,200 KN/m. That allows pressure impulses of more than approximately 60 KPa s to be achieved. However, because those values are subject to upper limits from the viewpoint of mechanical engineering and cost, as well as the strength of the press felt, use appears particularly appropriate for producing fibrous material webs having a basis weight between approximately 50 and 200 g/m$^2$, preferably between approximately 50 and 100 g/m$^2$, and/or producing wood-free paper webs. In all other cases, the requirements for the press section would be relatively high, but also feasible.

To guarantee a constant dry content of at least approximately 18%, preferably at least approximately 20%, at least one suction device that suctions the water from the fibrous material web through the former screen should be disposed in the former before the transition point of the fibrous material web onto the press section. However, it is also possible, in combination or alone, for the fibrous material web to be guided jointly with at least one endless circulating water-absorbent or water-permeable belt through a pre-press nip that is preferably formed by two rolls in the former before the transition point of the fibrous material web onto the press section. In the case of the combination, i.e., when the pre-press nip is formed by two rolls in the form of a suctioned roll and a press roll, the former screen should loop around the suctioned roll as a water-permeable belt.

To receive the water pressed out in the pre-press nip, at least one roll in the form of a press roll should also be looped around by a water-absorbent belt in the form of a press felt.

Moreover, a moistening device, preferably in the form of a steam blower box to act on the moisture cross profile of the fibrous material web, should be present in the press section before the press nip. Therefore, it is possible for the uniformizing effect of multiple press nips within the press section not merely to be achieved, but also to be exceeded. For that purpose, at least in the press section or in a subsequent unit, sensors that act on at least the moistening device should be disposed to record the moisture cross profile of the fibrous material web. The results of those sensors can also be used to control the suction device and/or the pressure force in the pre-press nip in the former. However, this requires at least the moistening device, but preferably also the suction device and/or the pressure force, to be controllable separately in zones crosswise to the fibrous material web.

Because a great deal of water is present in the single press nip of the press section, the fibrous material web should leave the press nip horizontally or slanted downward, and a channel to collect the water spun off by the upper press roll should be disposed at least over the upper press felt.

In addition, as described above, at least the first dryer group should be very short, preferably formed by a maximum of two, in particular by a maximum of one, heated dryer cylinders.

The present invention is directed to a machine for at least one of producing and finishing a fibrous material web. The machine includes a press section, for dewatering the fibrous web, with a press nip, a former, located before, relative to a web travel direction, the press section for sheet formation, and a dryer section, located after the press section for drying the fibrous material web including a first dryer section having no more than three dryer cylinders. Two press rolls are arranged to form the press nip, and at least one press felt is located on each surface of the material web, such that the material web and the at least one press felt on each side of the material web are guided through the press nip. The fibrous material web is dewatered in the former to a dry content of at least approximately 18%, partially loops around the no more than three dryer cylinders, and is constantly supported from the former to an end of the first dryer group.

In accordance with a feature of the invention, the dryer section can include only one press nip. Further, the fibrous material can be dewatered in the former to a dry content of approximately 20%, and the material web may be constantly supported by at least one of a belt and a roll.

According to another feature of the present invention, a length of the press nip may be greater than approximately 300 mm, and preferably the length of the press nip may be greater than approximately 500 mm.

In accordance with another feature of the instant invention, a line force in the press nip can be above approximately 800 KN/m, preferably above approximately 1,000 KN/m, and most preferably above approximately 1,200 KN/m.

Further, the machine may include at least one suction device located in the former and before a point at which the fibrous web is transferred to the press section. The at least one suction device can provide a dry content of at least approximately 18%. Further, the at least one suction device provides a dry content of at least approximately 20%.

The former may include a pre-press nip having two rolls and at least one endless belt guided through the pre-press nip. At a point before the fibrous material web is transferred to the press section, the fibrous material web can be guided jointly with the at least one endless belt through the pre-press nip. The at least one endless belt may include at least one of a water-absorbent and a water-permeable belt. The two rolls of the pre-press nip can include a suctioned roll and a press roll, and the endless belt can include a former screen looping around the suctioned roll. The two rolls of the pre-press nip can include at least one press roll, and the endless belt can include a press felt looping around the at least one roll.

According to a further feature of the invention, the press section can further include a moistening device positioned before the press nip adapted to influence a moisture cross-profile of the fibrous material web. The moistening device can include a steam blower box. Further, sensors can be adapted to record the moisture cross-profile of the fibrous material web. The sensors can be coupled to the moistening device and can be located in at least one of the press section and the dryer section. The former can include a pre-press nip and a suction device, and the sensors may be coupled to at least one of the pre-press nip and the suction device.

In accordance with a still further feature of the present invention, the fibrous material web may leave the press nip one of horizontally or slanted downwardly, and the machine can further include a channel to collect the water spun off by an upper press roll, which is located at least over an upper press felt.

Further, the first dryer group can include no more than two heated dryer cylinders. Moreover, the first dryer group can include only one heated dryer cylinder.

A basis weight of the fibrous material web being produced can be between approximately 50 and 200 g/m$^2$, and preferably the basis weight is between approximately 50 and 100 g/m$^2$.

In accordance with still another feature of the instant invention, the fibrous material web can include wood-free paper.

According to still another feature of the present invention, web speed may not exceed approximately 1,500 m/min.

The present invention is directed to a process for at least one of producing and finishing a fibrous material web in a machine that includes a former, a press section, and a dryer section. The process includes dewatering the fibrous material web in the former to dry content of at least approximately 18%, dewatering the fibrous material web in only one press nip in the press section, and looping the fibrous material web around no more than three dryer cylinders in a first dryer group of the dryer section a dryer section. The fibrous material web is constantly supported between the former and an end of the first dryer group.

According to a feature of the invention, the fibrous material can be dewatered in the former to a dry content of approximately 20%.

In accordance with yet another feature of the present invention, the process can further include pre-pressing the fibrous material web in the former in a pre-press. The process can also include measuring a moisture cross-profile of the fibrous material web with sensors located in at least one of the press section and the dryer section, and moistening the fibrous material web before, relative to a web travel direction, the one press nip in the press section. The sensors may be coupled to adjust the pre-press. The pre-press can include a suction device, and the sensors may be coupled to adjust the suction device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE shows a schematic section of a paper machine for producing a wood-free paper web having a finished basis weight of between approximately 50 and 100 g/m$^2$.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the illustrated end area of the former 2, the fibrous material web 1 is guided from a water-permeable former screen 10 supported at the transition point onto the press section 4. In the former 2, the fibrous material web 1 is dewatered to a dry content of at least approximately 20%. To constantly guarantee this, the fibrous material web 1 is guided jointly with the former screen 10 and a water-absorbent press felt 19 through a pre-press nip 16 formed by a suctioned roll 17 and a press roll 18. When that is done, the water is suctioned through the water-permeable belt 15 in the form of a former screen 10 into a suction device 12 in the form of the suctioned roll 17. On the opposite side, the pressed-out water is collected from the water-absorbent belt 25 in the form of the press felt 19 and carried away.

Subsequently, dewatering is performed in the elongated press nip of the press section 4 formed by the two press rolls 5, with each press roll 5 being looped around by an endless circulating press felt 6, 7. For example, the fibrous material web 1 is transferred from the former screen 10 onto the upper press felt 6 which is supported by a suctioned guide roll 22 of the upper press felt 6. After both press felts 6, 7 are combined, the lower press felt 7 is guided over a moistening device 13 in the form of a steam blower box whose steam is used to influence the moisture cross profile of the fibrous material web 1.

After the press nip, the lower press felt 7, along with the fibrous material web 1, is separated from the upper press felt 6, which is supported by a separation suction box 24. Subsequently, the fibrous material web 1 is transferred onto the dryer screen 11 of the first dryer group 8, which is also supported by a suctioned guide roll 22' of the dryer screen 11.

Because a great deal of water exits in the single press nip of the press section 4, the upper press felt 6 leaves the press nip slanting downward, so that a great deal of room remains for a channel 20 for collection of the spun-off water of the upper press roll 5. Naturally, a channel can also be used under the lower press roll 5'. After the press nip or the delivery of the fibrous material web 1, both press felts 6, 7 must be cleaned and dried by conditioning devices 21 and 21'.

The first dryer group 8 comprises only one heated dryer cylinder 9 over which the fibrous material web 1 is guided, while the fibrous material web 1 is pressed by the dryer screen 11 of that dryer group 8 against the dryer cylinder 9.

From the former 2 up to the dryer section 3, the fibrous material web 1 is always supported by one roll or one belt, so that a secure path of the fibrous material web 1 is also guaranteed even at high speeds. The generally endless circulating belts are guided over normal guide rolls 23 or suctioned guide rolls 22.

From the dryer cylinder 9, the fibrous material web 1 is taken up by the dryer screen 11' of the subsequent dryer group, while naturally the dryer screen 11 of the first dryer group 8 has first been guided away. That transfer makes it possible to run at a higher speed in the second dryer group than in the first dryer group 8. The result is that stretching of the fibrous material web 1 can be compensated to avoid the formation of folds and tears.

In the subsequent dryer groups, the fibrous material web 1 is guided jointly with the dryer screen 11 of the respective dryer group in an analogous fashion alternately over the dryer cylinder 9 and the suctioned guide roll 22".

At the beginning of the dryer section 3, in this case, for example, in the area surrounding a suctioned guide roll 22, the moisture cross profile of the fibrous material web 1 is measured by sensors 14. The result of that measurement is used in controlling the moistening device 13, the vacuum height of the suction roll 17, and the pressure forces coming from the press roll 18. In that regard, moistening, suctioning, and pressing are separately controllable in zones crosswise to the fibrous material web. That allows the production of the most uniform possible moisture cross profile of the fibrous material web 1, even with only one press nip in the press section 4.

The press nip itself is formed by a cylindrical lower press roll 5 and an upper shoe press roll 5, with the shoe press roll 5 being made of a flexible press casing that it guides over a pressure shoe having a concave pressure surface. That allows formation of long press nips over approximately 300 mm in length. In that regard, the line force in the press nip is over approximately 1,000 KN/m and the web speed is approximately 1,200 m/min.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are sandwiched together before being guided through said press nip;

wherein the fibrous material web is dewatered in said former to a dry content of at least approximately 18%, partially loops around said no more than three dryer cylinders, and is constantly supported from said former to an end of said first dryer group.

2. The machine in accordance with claim 1, wherein said press section comprise only one press nip.

3. The machine in accordance with claim 2, wherein the fibrous material is dewatered in said former to a dry content of approximately 20%, and wherein the material web is constantly supported by at least one of a belt and a roll.

4. The machine in accordance with claim 1, wherein a line force in said press nip is above approximately 800 KN/m.

5. The machine in accordance with claim 4, wherein said line force is above approximately 1,000 KN/m.

6. The machine in accordance with claim 4, wherein said line force is above approximately 1,200 KN/m.

7. The machine in accordance with claim 1, wherein said press section further comprises a moistening device positioned before said press nip adapted to influence a moisture cross-profile of the fibrous material web.

8. The machine in accordance with claim 7, wherein said moistening device comprises a steam blower box.

9. The machine in accordance with claim 7, further comprising sensors adapted to record the moisture cross-profile of the fibrous material web.

10. The machine in accordance with claim 9, wherein said sensors are coupled to said moistening device and are located in at least one of said press section and said dryer section.

11. The machine in accordance with claim 9, wherein said former comprises a pre-press nip and a suction device, and wherein said sensors are coupled to at least one of said pre-press nip and said suction device.

12. The machine in accordance with claim 1, wherein the fibrous material web leaves said press nip one of horizontally or slanted downwardly, and said machine further comprises a channel to collect the water spun off by an upper press roll, which is located at least over an upper press felt.

13. The machine in accordance with claim 1, wherein said first dryer group comprises no more than two heated dryer cylinders.

14. The machine in accordance with claim 13, wherein said first dryer group comprises only one heated dryer cylinder.

15. The machine in accordance with claim 1, wherein the fibrous material web comprises wood-free paper.

16. The machine in accordance with claim 1, wherein a web speed does not exceed approximately 1,500 m/min.

17. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are guided through said press nip;

wherein the fibrous material web is dewatered in said former to a dry content of at least approximately 18%, partially loops around said no more than three dryer cylinders, and is constantly supported from said former to an end of said first dryer group, and wherein a length of said press nip is greater than approximately 300 mm.

18. The machine in accordance with claim 17, wherein said length of said press nip is greater than approximately 500 mm.

19. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are guided through said press nip;

wherein the fibrous material web is dewatered in said former to a dry content of at least approximately 18%, partially loops around said no more than three dryer cylinders, and is constantly supported from said former to an end of said first dryer group; and at least one suction device located in said former and before a point at which the fibrous web is transferred to said press section, wherein said at least one suction device achieves the dry content of at least approximately 18%.

20. The machine in accordance with claim 19, wherein said at least one suction device provides a dry content of at least approximately 20%.

21. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are guided through said press nip;

wherein the fibrous material web is dewatered in said former to a dry content of at least approximately 18%, partially loops around said no more than three dryer cylinders, and is constantly supported from said former to an end of said first dryer group, wherein said former comprises a pre-press nip comprising two rolls and at least one endless belt guided through said pre-press nip, and wherein, at a point before the fibrous material web is transferred to said press section, the fibrous material web is guided jointly with said at least one endless belt through said pre-press nip.

22. The machine in accordance with claim 21, wherein said at least one endless belt comprises at least one of a water-absorbent and a water-permeable belt.

23. The machine in accordance with claim 21, wherein said two rolls of said pre-press nip comprise a suctioned roll and a press roll, and said endless belt comprises former screen looping around said suctioned roll.

24. The machine in accordance with claim 21, wherein said two rolls of said pre-press nip comprise at least one press roll, and said endless belt comprises a press felt looping around said at least one press roll.

25. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip; and at least one press felt being located on each surface of the material web, wherein the material web and said at least one press felt on each side of the material web are guided through said press nip;

wherein the fibrous material web is dewatered in said former to a dry content of at least approximately 18%, partially loops around said no more than three dryer cylinders, and is constantly supported from said former to an end of said first dryer group, and wherein a basis weight of the fibrous material web being produced is between approximately 50 and 200 g/m$^2$.

26. The machine in accordance with claim 25, wherein said basis weight is between approximately 50 and 100 g/m$^2$.

27. A process for at least one of producing and finishing a fibrous material web in a machine that includes a former, a press section, and a dryer section, the process comprising:

dewatering the fibrous material web in the former to dry content of at least approximately 18%;

dewatering the fibrous material web in only one press nip in the press section, wherein the fibrous material web is sandwiched between press felts before being guided into the only one press nip;

looping the fibrous material web around no more than three dryer cylinders in a first dryer group of the dryer section a dryer section, wherein the fibrous material web is constantly supported between the former and an end of the first dryer group.

28. The process in accordance with claim 27, wherein the fibrous material is dewatered in the former to a dry content of approximately 20%.

29. The process in accordance with claim 27, further comprising:

pre-pressing the fibrous material web in the former in a pre-press.

30. The process in accordance with claim 29, further comprising:

measuring a moisture cross-profile of the fibrous material web with sensors located in at least one of the press section and the dryer section; and moistening the fibrous material web before, relative to a web travel direction, the one press nip in the press section.

31. The process in accordance with claim 30, wherein the sensors are coupled to adjust the pre-press.

32. The process in accordance with claim 31, wherein the pre-press comprises a suction device, and said sensors are coupled to adjust the suction device.

33. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are guided through said press nip, wherein the fibrous material web is dewatered in said former to a dry content of at least approximately 18%, partially loops around said no more than three dryer cylinders, and is constantly supported from said former to an end of said first dryer group; and at least one moisture cross profile sensor.

34. The machine in accordance with claim 33, wherein said at least one moisture cross profile sensor is positioned in said dryer section.

35. The machine in accordance with claim 34, wherein said at least one moisture cross profile sensor is arranged to control at least one of moistening, suctioning and pressing of the web.

36. A machine for at least one of producing and finishing a fibrous material web, comprising:

a press section, for dewatering the fibrous web, comprising a press nip;

a former, located before, relative to a web travel direction, said press section for sheet formation;

a dryer section, located after said press section for drying the fibrous material web comprising a first dryer section having no more than three dryer cylinders;

two press rolls arranged to form said press nip;

at least one press felt being located on each surface of the material web, wherein the material web and said at least one press felt on each side of the material web are sandwiched together before being guided through said press nip; and at least one of (A) at least one suction device located in said former and before a point at which the fibrous web is transferred to said press section, wherein said at least one suction device achieves the dry content of at least approximately 18% and (B) said former comprising a pre-press nip comprising two rolls and at least one endless belt guided through said pre-press nip, wherein, at a point before the fibrous material web is transferred to said press section, the fibrous material web is guided jointly with said at least one endless belt through said pre-press nip, wherein the fibrous material web is dewatered in said former to a dry content of at least approximately 18%, partially loops around said no more than three dryer cylinders, and is constantly supported from said former to an end of said first dryer group, and wherein a length of said press nip is greater than approximately 300 mm and a basis weight of the fibrous material web being produced is between approximately 50 and 200 g/m$^2$.

* * * * *